United States Patent [19]

Voorheis

[11] Patent Number: 4,629,416

[45] Date of Patent: Dec. 16, 1986

[54] BLUFF BODY REGISTER

[75] Inventor: James T. Voorheis, Essex Fells, N.J.

[73] Assignee: Voorheis Industries, Inc., Fairfield, N.J.

[21] Appl. No.: 743,468

[22] Filed: Jun. 11, 1985

[51] Int. Cl.[4] ..... F23D 14/02

[52] U.S. Cl. ..... 431/352; 431/173; 431/182; 431/284; 60/759

[58] Field of Search ..... 431/351, 352, 173, 175, 431/182, 186, 284; 60/759, 758, 757

[56] References Cited

U.S. PATENT DOCUMENTS

| | | | |
|---|---|---|---|
| 3,074,469 | 1/1963 | Babbitt et al. | 431/158 X |
| 3,163,203 | 12/1964 | Ihlenfield | 431/284 X |
| 3,531,230 | 9/1970 | Apolinarski | 431/352 |
| 3,738,106 | 6/1973 | Stein et al. | 60/759 X |
| 3,831,854 | 8/1974 | Sato et al. | 431/352 X |
| 3,974,647 | 8/1976 | Lewis et al. | 431/352 X |
| 4,096,996 | 6/1978 | Ketchum | 431/352 |
| 4,122,670 | 10/1978 | Reider | 431/352 X |
| 4,240,785 | 12/1980 | Crawford | 431/352 |
| 4,347,052 | 8/1982 | Reed et al. | 431/284 X |
| 4,507,075 | 3/1985 | Buss et al. | 431/352 X |

*Primary Examiner*—Randall L. Green
*Attorney, Agent, or Firm*—David A. Jackson

[57] ABSTRACT

A burner assembly includes a register having a circular front wall and an annular side wall; a plurality of cylindrical bluff body elements circumferentially spaced about the annular side wall in a plurality of axially spaced rows for supplying air to the register; fuel supply assemblies which supply at least one of coal, gas and oil to the register for mixing with the air; and a plurality of bluff body discs, each positioned within a respective bluff body element for increasing the velocity and pressure drop of the air entering the register so as to enhance mixing of the fuel and the air within the register, and to reduce the NOx.

16 Claims, 12 Drawing Figures

BLUFF BODY REGISTER

BACKGROUND OF THE INVENTION

This invention relates generally to burner assemblies and, more particularly, is directed to a register for a burner assembly.

Burner assemblies in which gas, oil, coal and other combustible materials are mixed with air are well known in the art. Such burner assemblies are generally associated with industrial boilers and furnaces, and comprise a structure known as a register which is usually mounted at the base of the furnace or boiler, and which contains appropriate fuel and air inlets, and houses the burner gun that serves to ignite the fuel. Thus, the combustible material, such as oil, coal and gas, enters the register through appropriate inlets formed in the register. In order to provide efficient mixing of the air with the fuel, a plurality of entry ports are generally positioned within the annular side wall of the register, such that the air impacts the combustible material at an angle thereto so as to provide enhanced mixing. Additionally, the entry ports within the annular side wall may be inclined so as to provide a tangential spin to the air supplied to the register.

With such conventional arrangement, the problem of adequate mixing of the air with the combustible material still remains. In other words, it is still desirable to obtain more effecient and effective mixing of the air and fuel.

Related to this problem of inadequate air balance, that is, inadequate mixing of the fuel and air, there is the problem of reducing nitrous oxides (hereinafter referred to as NOx), resulting from oxidation of nitrogen in the air, which, in turn reduces the flame retention, thereby providing for lowered radiation.

As discussed in U.S. Pat. No. 4,297,093, various methods have been used for suppressing the generation of NOx, such as reduction of the flame temperature, reduction of oxygen concentration in the combustion zone and shortening of the stay time of the combustion gas in the combustion zone of high temperature. However, as described therein, the adoption of these techniques also poses various problems concerning stability of the flame, emission of unburnt substances and smoke, responsive characteristic to the fluctuation of load, thermal efficiency, the cost of modification of the boiler, increase of the fuel consumption, and the like. U.S. Pat. No. 4,297,093 discloses an arrangement for reducing NOx by utilizing a swirler to provide a small scale of turbulence to the combustion air. The swirler is located in the vicinity of the fuel injection port.

Related to the turbulence discussed above, it is known that the flow velocity of a combustible mixture is reduced when an obstacle is placed in the flow path thereof. Accordingly, the chances for the flame speed to match the flow velocity at some region in the flow field, a requirement of flame stabilization, are improved. If the obstacle is a bluff body, that is, a non-streamlined body, as the fluid is accelerated, a flow velocity is reached where the adverse pressure gradient downstream from the obstacle is strong enough to set up a recirculating vortex system in the wake of the bluff body, as taught by *Combustion Aerodynamics,* J. M. Beer and N. A. Chigier, Halsted Press Division, John Wiley and Sons, Inc., New York, pages 68 and 73.

OBJECTS AND SUMMARY OF THE INVENTION

Accordingly, it is an object of the present invention to provide a burner assembly that provides an excellent air balance, regardless of the fuel utilized.

More particularly, it is an object of the present invention to provide a burner assembly that provides maximum turbulence for air entering the register with a pressure drop, resulting in enhanced mixing of the air and fuel.

It is another object of the present invention to provide a burner assembly that reduces NOx.

It is still another object of the present invention to provide a burner assembly that provides enhanced air balance and reduced NOx, and which can be used with coal, gas and/or oil as the fuel for the mixture.

It is a further object of the present invention to provide a burner assembly including bluff bodies which can be changed to vary the turbulence of air entering the register thereof.

It is a still further object of the present invention to provide a modification that can be utilized with coventional burner assemblies to provide excellent air balance and reduction of NOx.

In accordance with an aspect of the present invention, a burner assembly comprises register means having an annular wall; a plurality of bluff body element means circumferentially spaced about the annular wall in a plurality of axially spaced rows for supplying air to the register means; means for supplying a combustible material to the register means; and a plurality of bluff body disc means positioned within the bluff body element means for enhancing mixing of the combustible material and the air within the register means.

The above, and other, objects, features and advantages of the present invention will become readily apparent from the following detailed description thereof which is to be read in connection with the accompanying drawings.

DETAILED DESCRIPTION OF THE PREFERRED EMBODIMENTS

Figure 1:
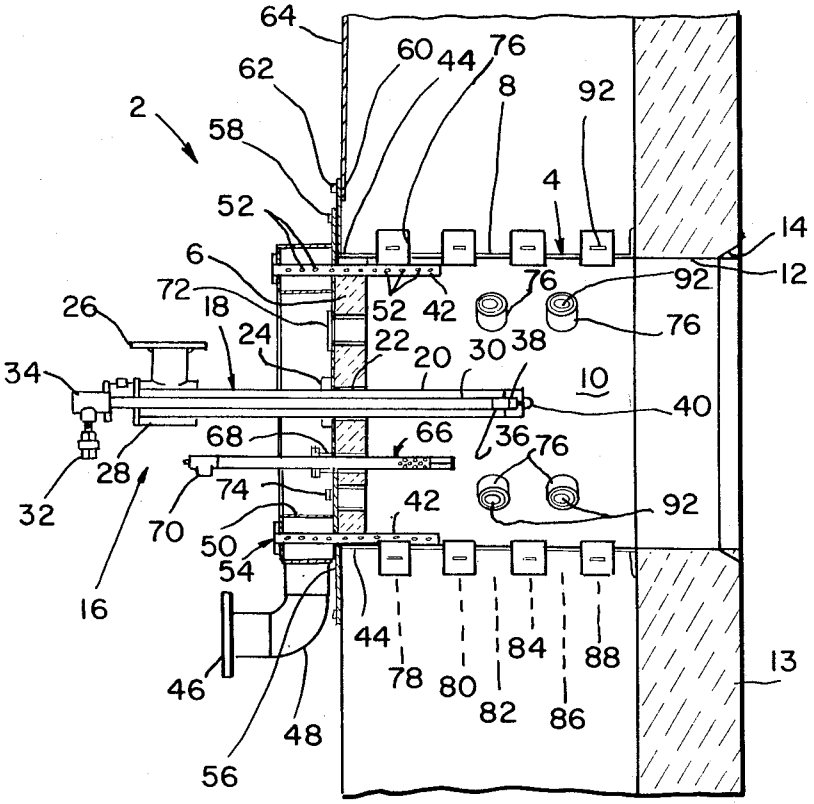
FIG. 1 is a schematic, cross-sectional view of a gas and oil burner assembly according to one embodiment of the present invention.
Figure 2:
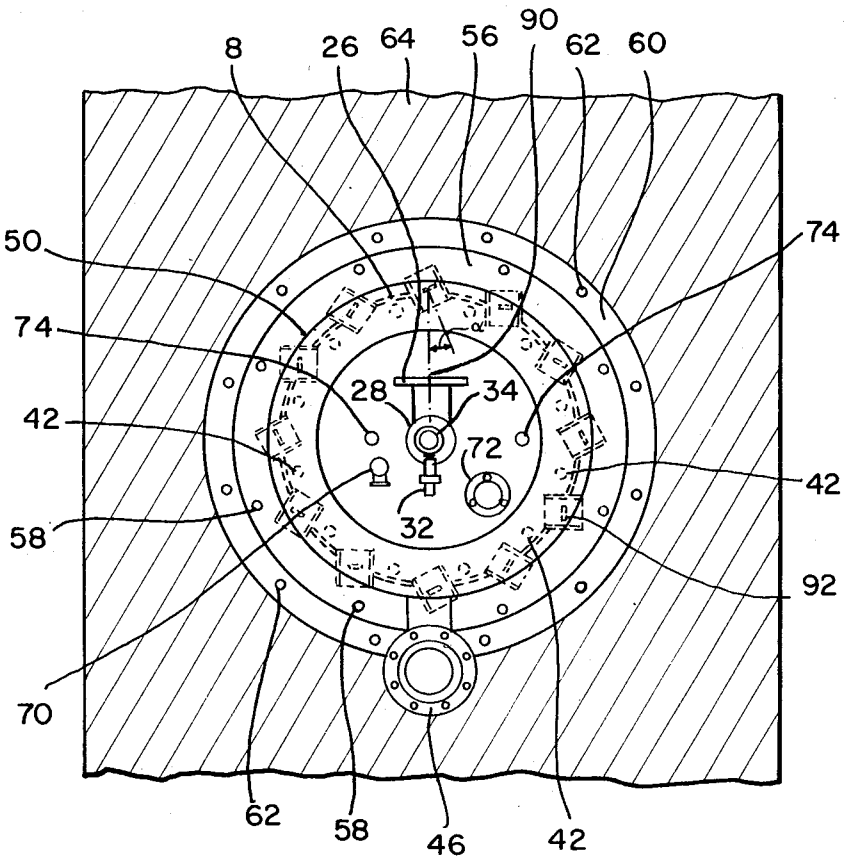
FIG. 2 is a front elevational view of the burner assembly of FIG. 1.

Referring to the drawings in detail, and initially to FIGS. 1 and 2 thereof, a burner assembly 2 according to the present invention, which utilizes gas and oil as the fuel components, generally includes a register 4 having a circular front or inlet wall 6 and a side circumferential or annular wall 8, preferably of an annular configuration, forming a cylindrical enclosure 10 within which the air and fuel are mixed. The outlet end of circumferential wall 8 is open, and is coextensive with an opening 12 in an outlet plate 13. Opening 12 preferably diverges, as at 14, at the exit thereof, for example, at a 45° angle.

Means 16 for supplying gas and oil to register 4 extends within front wall 6 thereof. In particular, means 16 includes an oil gun assembly 18 for use when oil is the main fuel. Oil gun assembly 18 includes a burner pipe 20 extending partly through an aperture 22 within front wall 6 and held in place thereof by an oil gun mounting bracket 24. Atomizing steam or air is supplied to burner pipe 20 from a socket flange 26 through an atomizing steam box 28.

An oil tube 30 is centrally positioned within burner pipe 20 for supplying oil to register 4. More particularly, oil pipe 30 is supplied with oil from an oil inlet pipe 32 through a regulator body 34, as is conventional, at the forward end of oil pipe 30 extending out of register 4. The opposite free end of oil pipe 30 is secured in a series connection to an atomizing air spinner 36, an oil spinner 38 and flow reversing nozzle 40 extending from burner pipe 20 and through which the atomized oil is discharged within register 4, for example, as disclosed in U.S. Patent Application Ser. No. 06/362,224, filed Mar. 26, 1982, now U.S. Pat. No. 4,526,322, to the same inventor herein, entitled "Flow-Reversing Nozzle Assembly", the entire disclosure of which is incorporated herein by reference.

When gas is the main fuel that is utilized, a plurality of gas tubes 42 are positioned circumferentially within front wall 6 for supplying gas to register 4. Each gas tube 42 is mounted within a rolled insulation cylinder 44 in front wall 6 so as to extend partly within and partly without register 4.

As shown in the Figures, a gas header inlet 46 is connected through a welded elbow 48 to a circumferential gas header assembly 50 which is secured against the outer periphery of front wall 6 by welding or the like such that gas header assembly 50 surrounds gas tubes 42 for supplying gas thereto. Each gas tube 42 includes a plurality of apertures 52 at opposite ends thereof through which gas from gas header assembly 50 is supplied outside of register 4 and through which gas supplied to each tube 42 is emitted within register 4.

In accordance with an aspect of the present invention, a gas nozzle assembly 54 is provided in association with each gas tube 42 for adjusting the gas emissions within register 4 during operation thereof. As a result, the gas emissions can be adjusted to provide for high radiation and low NOx.

More particularly, the apertures 52 at the free end of gas tubes 42 within enclosure 10 are arranged thereon in the axial direction along a single line. Thus, by turning each gas nozzle assembly 54, and thereby, each gas tube 42, apertures 52 are pointed in the tangential direction, the inwardly radial direction or any position therebetween within register 4. It is generally desirable to adjust gas tubes 42 such that they correspond to a position where lowest excess air is obtained, ususally in the range of 5–10%. The rotational position of gas tubes 42 is determined by experiment to obtain the lowest excess air. In other words, rotation of gas tubes 42 provides a gas-air mixture control.

Figure 12:
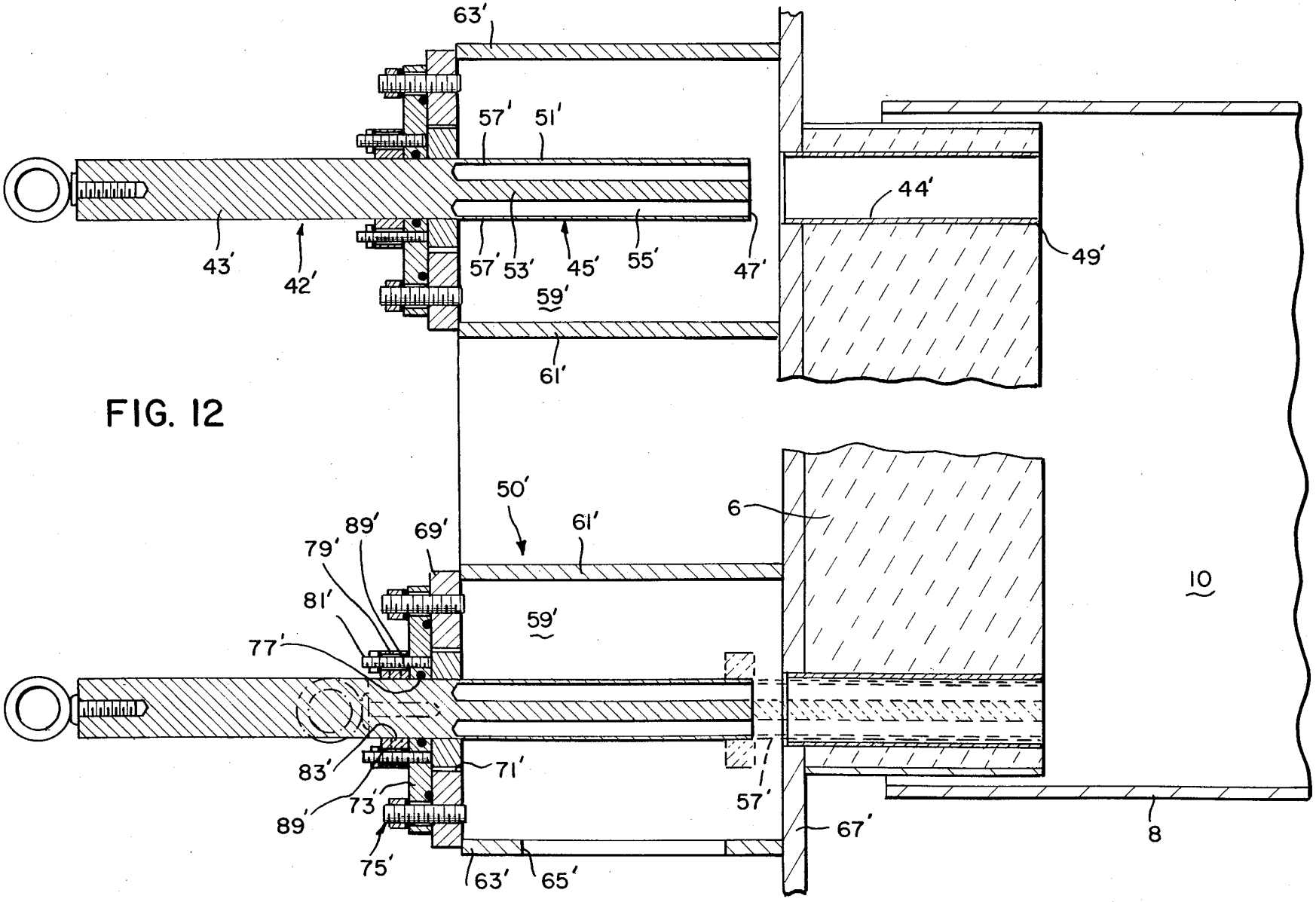
FIG. 12 is a cross-sectional view of a gas inlet assembly according to another embodiment of the present invention for use with the gas and oil burner assembly of FIG. 1.

Referring now to FIG. 12, an alternate embodiment for supplying and regulating the flow of gas to register 4 includes a plurality of gas tubes 42′ positioned circumferentially within front wall 6 for supplying gas to register 4.

Each gas tube 42′ is formed in the general configuration of an elongated shaft. More particularly, each gas tube 42′ includes a control section 43′ and a continuous gas inlet section 45′ which is adapted to slide within a respective rolled insulation cylinder 44′ in front wall 6 such that the free end 47′ thereof is substantially flush with the end 49′ of cylinder 44′ when extending fully within register 4, as shown by the phantom dot-dash chain line in the lower half of FIG. 12. Control section 43′ is preferably solid, while gas inlet section 45′ is formed with a thin cylindrical outer wall 51′ and a centrally positioned cylindrical rod 53′ so as to define an annular passageway 55′ extending in the axial direction therethrough. Spaced apertures 57′ are circumferentially disposed in outer wall 51′ adjacent to the position where control section 43′ and gas inlet section 45′ meet.

In the embodiment of FIG. 12, gas header assembly 50′ is defined by an annular passageway 59′ defined between an inner cylinder wall 61′ and an outer cylinder wall 63′, outer cylinder wall 63′ being formed with an inlet opening 65′ for the supply of gas to header assembly 50′. One end of cylinders 61′ and 63′ are welded to a front plate 67′ made, for example, of thick carbon steel, which is welded to front wall 6. The opposite ends of cylinders 61′ and 63′ are welded to an annular gas header flange 69′ having an annular opening 71′ centrally positioned with respect to annular passageway 59′. An annular gas header seal plate 73′ is secured to the outer face of gas header flange 69′ by means of studs 75′ extending outwardly from gas header flange 69′ within respective apertures in gas header seal plate 73′ and secured by lock washers and hex nuts. Annular gas header seal plate 73′ is formed with a plurality of circumferentially arranged apertures 77′ through which gas tubes 42′ slide. A "Stafford" one piece clamp 79′ is secured by means of studs 81′ extending outwardly from gas header seal plate 73′ by means of lock washers and hex nuts to the outer face of gas header seal plate 73′ with central openings 83′ thereof being in alignment with apertures 77′ for further supporting gas tubes 42′ and for locking gas tubes 42′ in fixed axial positions by means of set screws 89′, shown in phantom.

In the embodiment of FIG. 12, circumferentially arranged gas tubes 42′ are axially and individually moved to control the flow of gas such that the lowest excess air is obtained. In this regard, the higher the color of the flame, the more efficient the flame is. However, if the color of the flame is too high, the system becomes inefficient since the lowest excess air is not obtained. It is therefore important to properly position gas tubes 42′ such that the lowest excess air is obtained with the highest efficiency. At such positions, tubes 42′ are locked in place by set screws 89′, although bolts, welds or the like may be used to lock tubes 42' in position.

In operation, when gas tubes 42' are pulled out, for example, to the position shown by solid lines in FIG. 12, gas supplied to gas header assembly 50' through inlet 65' travels through rolled insulation cylinder 44' to cylindrical enclosure 10 of register 4. At this time, a relatively wide passageway is formed through cylinders 44'. To change the flame and thereby the amount of excess air, gas tubes 42' are moved toward and/or within cylinders 44', for example, as shown by the dot-dash chain line in the lower half of FIG. 12. The gas tubes 42' are not axially moved during operation, when gas is delivered and combustion occurs. In such position, gas enters circumferentially spaced apertures 57' and travels through annular passageways 55' into enclosure 10. Because there is effectively a restriction within cylinders 44', the gas velocity increases, thereby changing the flame and the amount of excess air that is obtained. Of course, positions between those shown by the solid lines and dot-dash chain lines of FIG. 12 may be assumed. In such case, the gas has its flow passageway only partially restricted, that is, where gas inlet section 45' extends only part way within cylinder 44'. As an example, when gas tubes 42' are inserted as shown by the dot-dash chain line, a gas velocity of 400 ft./sec. is obtained, while a gas velocity of 200 ft./sec. is obtained when gas tubes are in the positions shown by the solid lines in FIG. 12.

Referring back to FIGS. 1 and 2, both front wall 6 and gas header assembly 50 are welded to a front plate 56 which, in turn, is secured by bolts 58 to a windbox front plate 60 secured by bolts 62 to a windbox 64 through which air is supplied to register 4.

A gas/electric pilot ignitor pipe 66 extends through a guide and flange assembly 68 within front wall 6 and includes a pilot gas inlet 70 at the end extending from register 4, as is conventional.

Various other openings are provided in front wall 6, as shown in FIGS. 1 and 2. For example, a peep sight glass 72 and a plurality of connectors 74 for "Fireye" scanners, are provided within front wall 6. It is to be noted that the scanner connectors 74, peep sight glass 72, and pilot gas inlet 70 are shown out of position in FIG. 1 in order to better illustrate these elements, and the true positions thereof are shown in FIG. 2. However, the positions thereof may be varied within the scope of the present invention. In like manner, the positions of atomizing steam inlet or socket flange 26, pilot gas inlet 70 and oil inlet pipe 32 may be interchanged depending on the particular application.

In accordance with an aspect of the present invention, a plurality of bluff body elements 76 in the form of hollow cylindrical passageways are circumferentially spaced about side wall 8 for supplying air to chamber 10 within register 4. Bluff body elements 76, in actuality, extend through circumferential side wall 8 so as to supply air from windbox 64 to chamber 10. With such arrangement, as the air enters chamber 10 through each bluff body element 76, there is a resultant pressure drop, whereby the air is caused to disperse through chamber 10 and thereby mix with the gas or oil fuel.

Generally, bluff body elements 76 are of a cylindrical configuration, as shown in FIG. 1, although the configuration may vary depending upon the particular application, for example, square or the like. Bluff body elements 76 are arranged in a plurality of rows 78, 80, 82, 84, 86, and 88. Although six rows are shown in FIG. 1, the number of rows may vary depending upon the particular application, within the scope of the present application as claimed. As also shown in FIG. 1, adjacent rows may be staggered or offset with respect to each other. For example, in FIG. 1, row 82 is staggered or offset with respect to rows 80 and 84, and row 86 is staggered or offset with respect to rows 84 and 88. The entire number of bluff body elements 76 is not shown in FIG. 1 for the sake of clarity in the drawing. Although FIG. 2 shows one row having twelve bluff body elements 76, it will be appreciated that this number may vary within the scope of the present application as claimed.

In order to enhance mixing of the air and fuel, bluff body elements 76 may be inclined at an angle to the radial line 90 connecting the center of register 4 with the respective entry port 76. In this regard, a tangential air flow is created which enhances the mixing of the air and fuel.

In accordance with an important and essential aspect of the present invention, a plurality of bluff body discs 92 are positioned within bluff body elements 76 for enhancing mixture of the fuel and air within register 4. The bluff body discs 92 create toroidal eddies that increase the turbulence of the air entering register 4 by increasing the velocity and pressure drop thereof, so as to provide enhanced mixing of the fuel and air. As a result, there is a reduction of NOx, without the necessity of providing a swirler at the air input.

Figure 11:
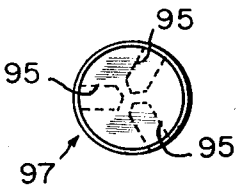
FIG. 11 is a bottom plan view of the center post of FIG. 10.
Figure 9:
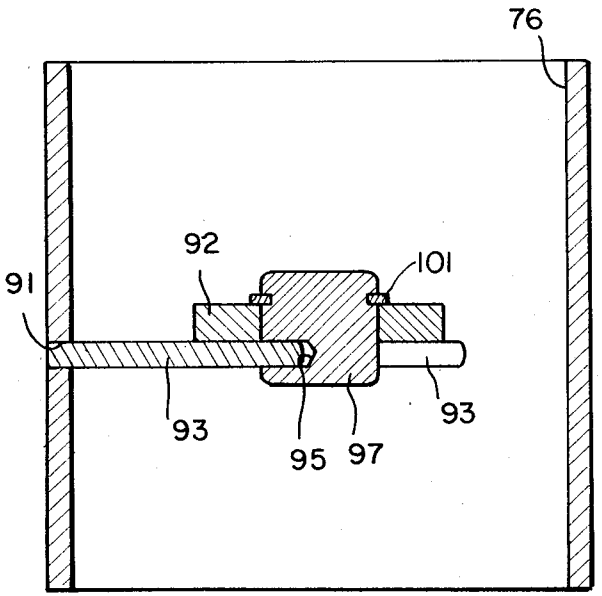
FIG. 9 is a cross-sectional view of the bluff body assembly of FIGS. 7 and 8, taken along lines 9—9 thereof.
Figure 10:
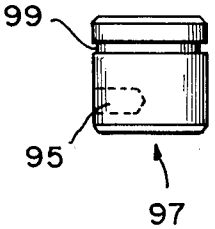
FIG. 10 is an elevational view of the center post of the bluff body assembly of FIG. 7.

Referring now to FIGS. 9–11, a particular arrangement of bluff body elements 76 and bluff body discs 92 will be described. Generally, each bluff body element 76 is formd in hollow cylindrical configuration having three equidistantly spaced apertures 91 formed centrally in the inside wall thereof. Three centering pins 93 have one end mounted within a respective aperture 91 and the opposite end thereof positioned within a respective one of three equidistantly spaced apertures 95 in a centr post 97 such that center post 97, having a cylindrical configuration, is centrally positioned with the respective bluff body element 76.

Each bluff body disc 92 is formed with an annular configuration and has an inside diameter substantially equal to the outside diameter of center post 97 and fits thereover so as to rest upon centering pins 93, as shown in FIG. 9.

Center post 97 further includes a circumferential groove 99, as shown in FIGS. 9 and 10, for reception of a retaining ring 101. Thus, after bluff body disc 92 is positioned on center post 97, retaining ring 101 is positioned within groove 99 so as to retain bluff body disc 92 centrally positioned within bluff body element 76.

With this arrangement, different outside diameter bluff body discs 92 may be readily interchanged to obtain different mixing characteristics.

Figure 3:
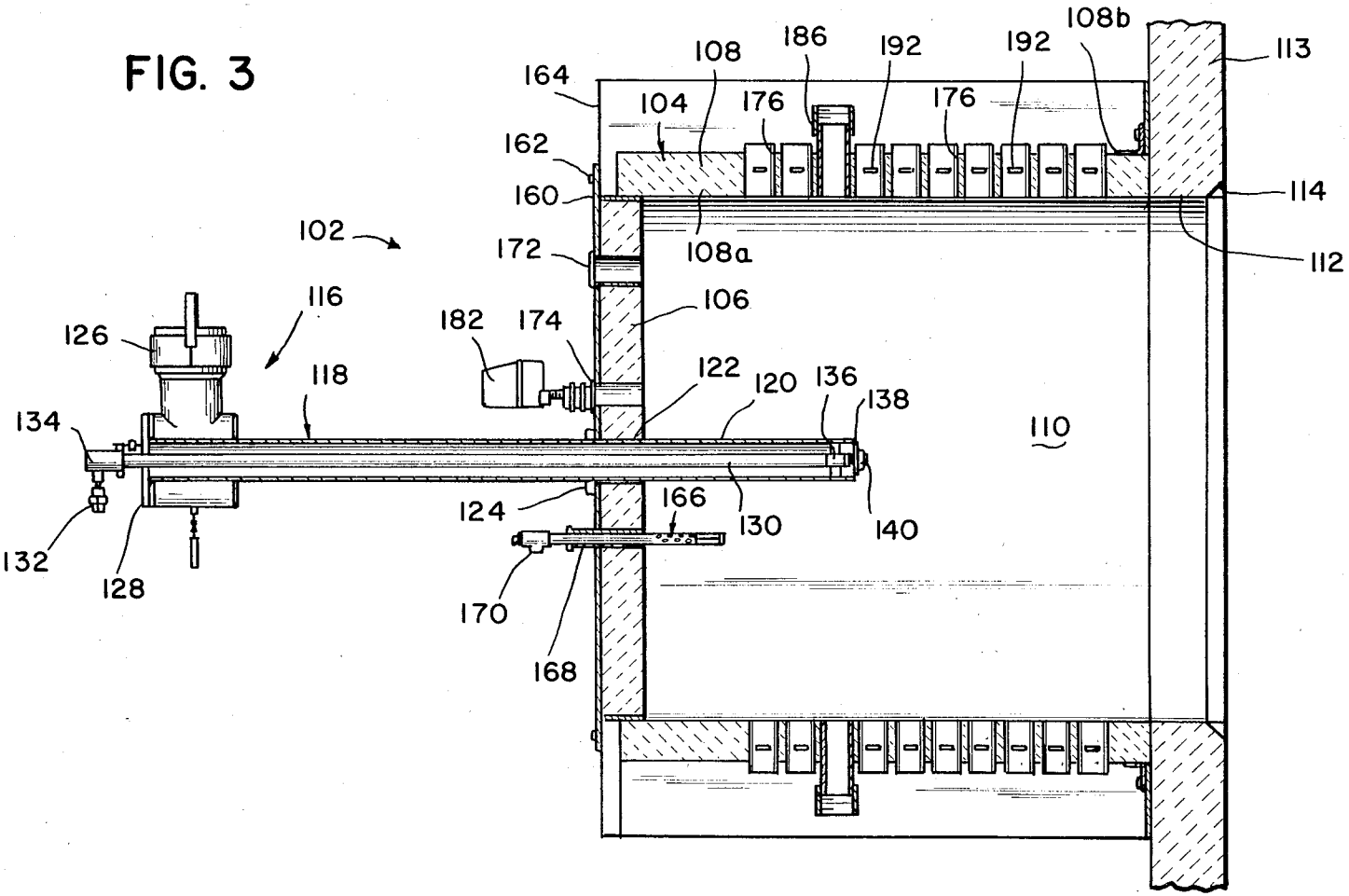
FIG. 3 is a schematic, cross-sectional view of an oil and coal burner assembly according to another emodiment of the present invention.
Figure 4:
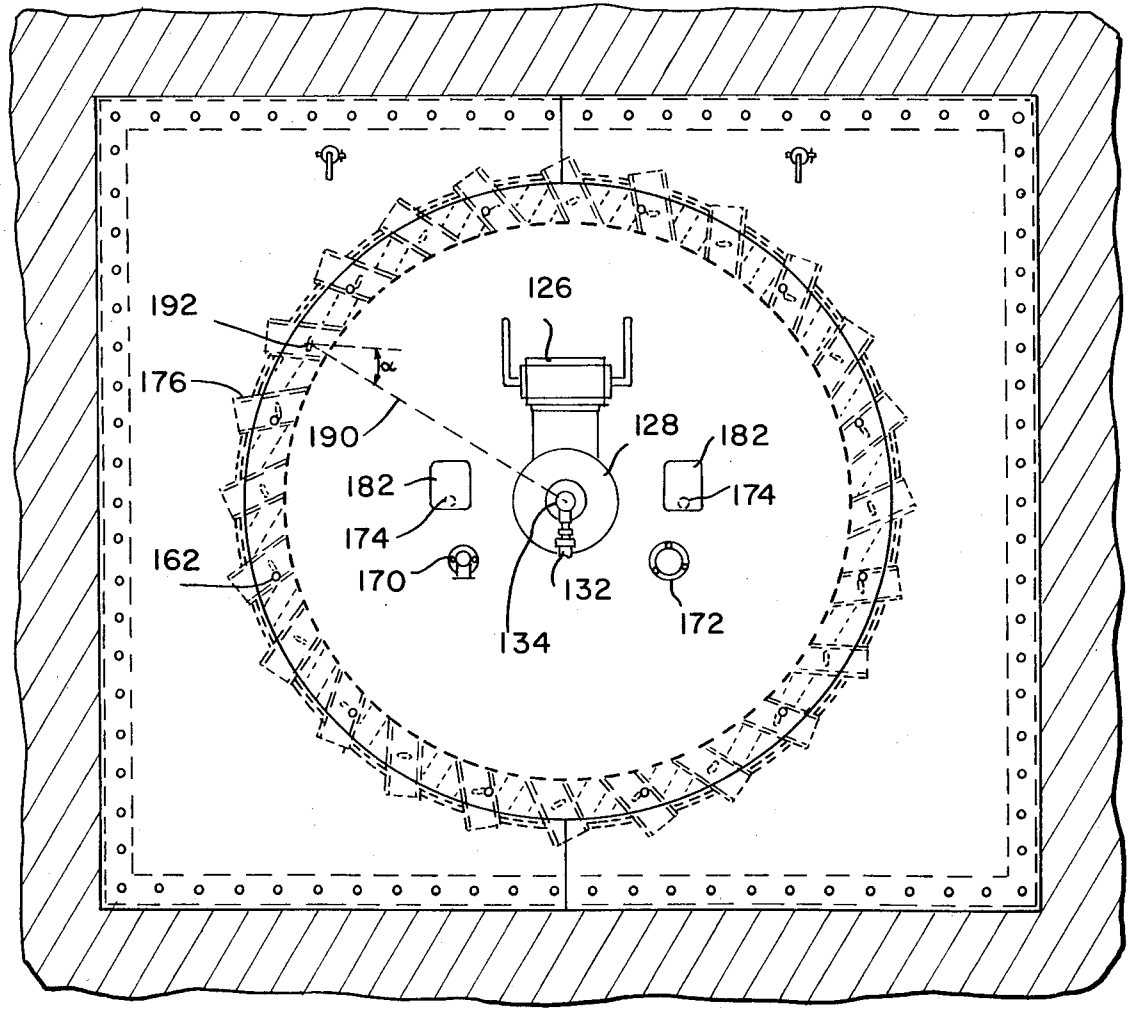
FIG. 4 is a front elevational view of the burner assembly of FIG. 3.

Referring now to FIGS. 3 and 4, a burner assembly 102 according to the present invention, which is used with oil and coil as the fuel, will now be described. Elements appearing in burner assembly 102 of FIGS. 3 and 4 which are the same as those appearing in burner assembly 2 of FIGS. 1 and 2 are identified by the same reference numerals, with the numeral being augmented by "100", and a detailed description of these elements will be omitted herein for the sake of brevity.

Since burner assembly 102 is not used with a gas fuel, gas header assembly 50 and gas tubes 42 are eliminated. In addition, existing scanners 182 are shown connected to connectors 174, as is conventional.

Because burner assembly 102 is used with a solid fuel, such as coal, circumferential side wall 108 is formed with a thick refractory lining 108*a*, such as ceramic or the like, along with an outer member 108*b* secured thereto which is used for securing circumferential side wall 108 to outlet plate 113 of the apparatus. The addition of a refractory lining 108*a* converts the register to a spin furnace for all solid fuels that are properly milled to burn in suspension.

In addition, pulverized coal entry ports 186 are provided within circumferential side wall 108 between the second and third rows of bluff body elements 176. The coal header is not shown in the drawings.

As with the embodiments of FIGS. 1 and 2, peep sight glass 172, scanners 182 and couplings 174 therefor, pilot gas inlet 170 and oil gun assembly 116 are shown correctly in position in FIG. 4, and the positions thereof are varied in FIG. 3 for the sake of clarity.

Figure 5:
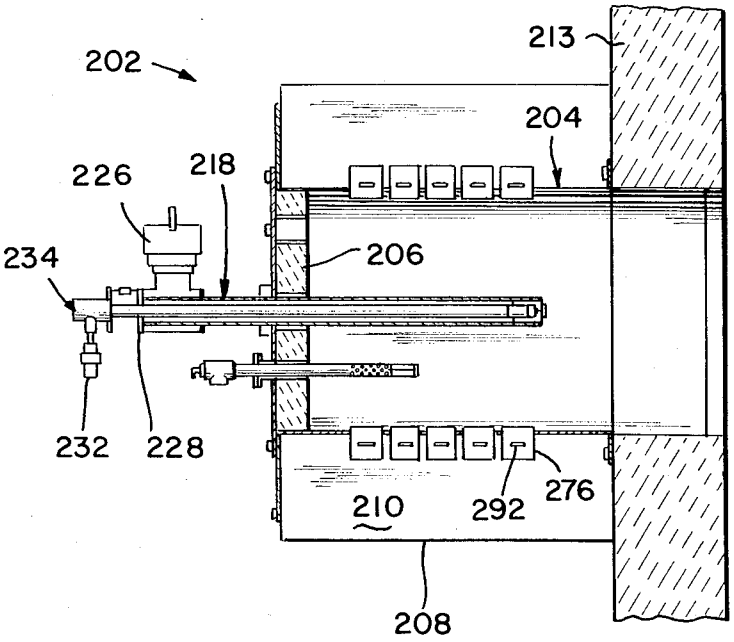
FIG. 5 is a schematic, cross-sectional view of an oil burner assembly according to yet another embodiment of the present invention.
Figure 6:
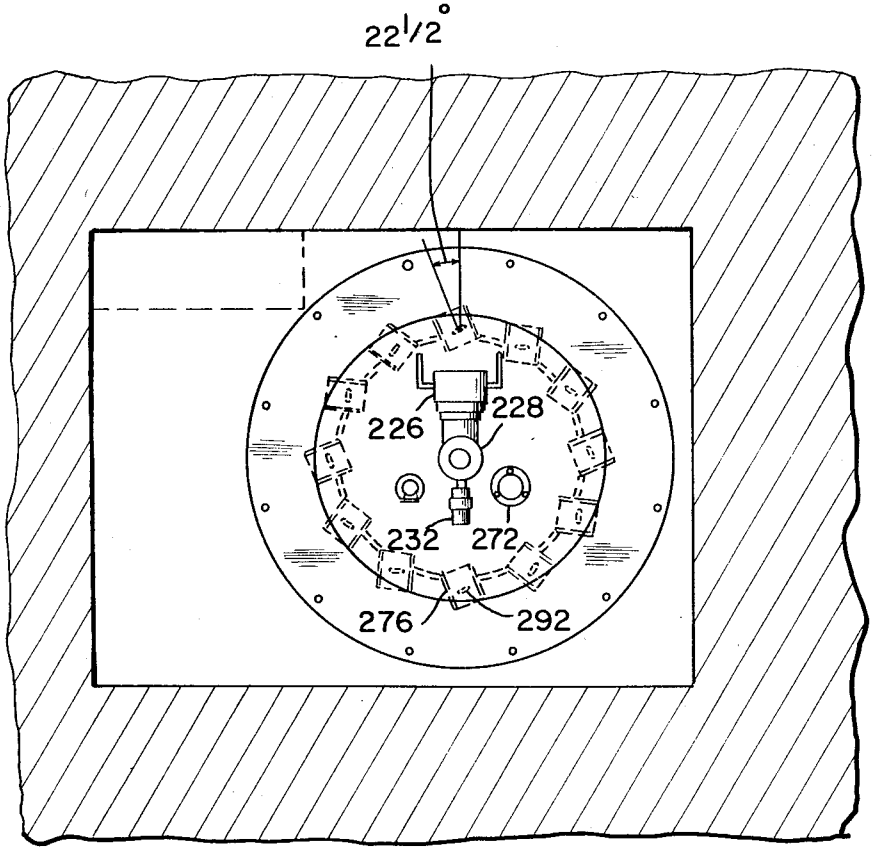
FIG. 6 is a front elevational view of the burner assembly of FIG. 5.
Figure 7:
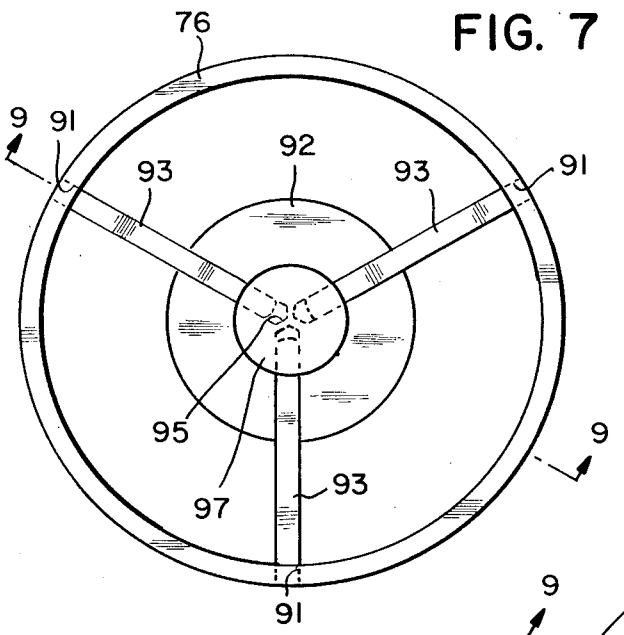
FIG. 7 is a bottom plan view of a bluff body assembly according to one embodiment of the present invention.
Figure 8:
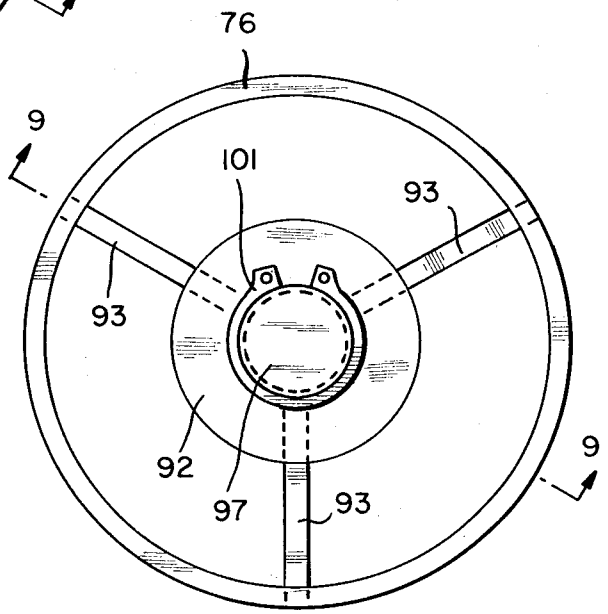
FIG. 8 is a top plan view of the bluff body assembly of FIG. 7.

Referring now to FIGS. 5 and 6, a burner assembly 202 accordingly to the present invention, which is used with oil only as the fuel, will now be described. Elements appearing in burner assembly 202 of FIGS. 5 and 6 which are the same as those appearing in burner assembly 2 of FIGS. 1 and 2 are identified by the same reference numerals, with the numeral being augmented by "200", and a detailed description of these elements will be omitted herein for the sake of brevity.

Since burner assembly 202 is not used with a gas fuel, gas header assembly 50 and gas tubes 42 are eliminated.

In all of the above embodiments, the use of bluff body discs 92, 192 and 292 results in an increased velocity and increased pressure drop, thereby increasing the dispersion of air within the chamber into mixing contact with the fuel also supplied thereto. This results in an enhanced air balance which, in turn, provides lower NOx, and a more efficient burner assembly.

It is particularly advantageous in the present invention that the bluff body discs may be changed, depending upon the application, to permit a determination of the minimum NOx values. Thus, existing burner assemblies can be readily modified in accordance with the present invention to provide a greater air balance and lower NOx.

Having described specific preferred embodiments of the invention with reference to the accompanying drawings, it is to be understood that the present invention is not limited to those precise embodiments, and that various changes and modifications may be effected therein by one of ordinary skill in the art without departing from the scope and spirit of the invention as defined by the appended claims.

What is claimed is:

1. A burner assembly comprising:

register means having an annular wall;

a plurality of transverse bluff body element means circumferentially spaced about said annular wall in a plurality of axially spaced rows for supplying air to said register means;

means for supplying a combustible material to said register means; and a plurality of substantially circular bluff body barrier means positioned substantially centrally within said bluff body element means for enhancing mixing of said combustible material and said air within said register means.

2. A burner assembly according to claim 1; wherein said bluff body element means in at least one row are staggered with respect to bluff body element means of at least one adjacent row.

3. A burner assembly according to claim 1; wherein said bluff body element means are inclined with respect to the radial direction of the annular wall of said register means.

4. A burner assembly according to claim 1; wherein said register means includes a front wall, and said means for supplying a combustible material includes oil gun means extending through said front wall of said register means, and said oil gun means is connected to a source of combustible material.

5. A burner assembly according to claim 4; wherein said oil gun means includes oil tube means extending through said front wall and having a first end positioned outside of said register means and a second, opposite end positioned within said register means; oil inlet means for supplying oil to said first end of said oil tube means; and atomizing media means connected to said second end for atomizing said oil supplied to said register means.

6. A burner assembly according to claim 5; wherein said oil gun means further includes regulator means connected between said oil inlet means and said first end for regulating the supply of oil to said oil tube means; and said atomizing media means includes spinning means for spinning said atomized oil supplied to said register means.

7. A burner assembly according to claim 1; wherein said means for supplying includes at least one combustible entry port for supplying a solid combustible material to said register means.

8. A burner assembly according to claim 7; wherein said means for supplying includes a plurality of combustible entry ports positioned circumferentially about said annular wall in at least one row positioned between adjacent rows of said bluff body element means.

9. A burner assembly according to claim 7; wherein said solid combustible material is coal.

10. A burner assembly according to claim 1; wherein said means for supplying includes a plurality of gas tubes extending within said register means for supplying gas thereto; and gas header means for supplying gas to said gas tubes.

11. A burner assembly according to claim 10; wherein said register means has a front wall; and said gas tubes are spaced around a peripheral portion of said front wall and extend within said register means between adjacent entry ports.

12. A burner assembly according to claim 11; wherein said plurality of gas tubes are axially moveable with respect to said register means to vary the supply of gas to said register means.

13. A burner assembly according to claim 1; wherein said combustible material is at least one of oil, gas and coal.

14. A burner assembly according to claim 1; wherein each said barrier means is formed as a substantially circular disc.

15. A burner assembly comprising:

register means having an annular wall and a front wall;

a plurality of transverse bluff body element means circumferentially spaced about said annular wall in a plurality of axially spaced rows for supplying air to said register means;

means for supplying a combustible material to said register means, including a plurality of gas tubes extending within said register means for supplying gas thereto, and said gas tubes are spaced around a peripheral portion of said front wall and extend within said register means between adjacent entry ports;

gas header means for supplying gas to said gas tubes; and means for rotatably displacing said plurality of gas tubes extending within said register means to provide gas flow ranging from tangential to radial flow within said register means; and a plurality of bluff body disc means positioned within said bluff body element means for enhancing mixing of said combustible material and said air within said register means.

16. A burner assembly comprising:

register means having an annular wall;

a plurality of transverse bluff body element means circumferentially spaced about said annular wall in a plurality of axially spaced rows for supplying air to said register means;

means for supplying a combustible material to said register means;

a plurality of bluff body disc means positioned within said bluff body element means for enhancing mixing of said combustible material and said air within said register means; and each said bluff body element means including means for removably securing a respective bluff body disc means substantially centrally therein.

* * * * *